United States Patent [19]

Kumagai

[11] 4,272,964

[45] Jun. 16, 1981

[54] STEAM GENERATING APPARATUS

[75] Inventor: Yoshio Kumagai, Takahagi, Japan

[73] Assignee: Hitachi, Ltd., Tokyo, Japan

[21] Appl. No.: 31,297

[22] Filed: Apr. 18, 1979

[30] Foreign Application Priority Data

Apr. 24, 1978 [JP] Japan ..... 53/47737

[51] Int. Cl.[3] ..... F01D 11/04; F22B 1/02

[52] U.S. Cl. ..... 60/657; 122/31 R

[58] Field of Search ..... 60/646, 657, 670; 122/31 R, 33, 483, 487

[56] References Cited

U.S. PATENT DOCUMENTS

| | | | |
|---|---|---|---|
| 1,674,024 | 6/1928 | Schroeder et al. | 60/657 |
| 3,022,985 | 2/1962 | Mair | 122/31 R |
| 3,062,553 | 11/1962 | Juzi | 60/646 X |
| 3,604,206 | 9/1971 | Baily | 60/644 |
| 3,935,710 | 2/1976 | Dickinson | 60/657 |

*Primary Examiner*—Allen M. Ostrager
*Assistant Examiner*—Stephen F. Husar
*Attorney, Agent, or Firm*—Craig and Antonelli

[57] ABSTRACT

In a steam generating apparatus comprising a shell containing feed water introduced thereinto, and heating pipes submerged in the feed water contained in the shell for permitting a heating fluid of high temperature to flow therethrough, indirect heat exchange being effected between the heating fluid and the feed water in the shell through the heating pipes so as to evaporate the feed water, spray means for supplying condensate in atomized particles to the shell and means for separating moisture from the generated steam are mounted in a space above the feed water level within the shell. The spray means has mounted therein resilient means for changing the area of openings for spraying the condensate according to the pressure of the condensate supplied to the spray means, and arrangement is such that the atomized particles of the condensate delivered into the shell through the spray means are brought into contact with the steam generated in the shell and heated thereby to a saturation temperature corresponding to the internal pressure of the shell.

8 Claims, 2 Drawing Figures

STEAM GENERATING APPARATUS

BACKGROUND OF THE INVENTION

This invention relates to a steam generating apparatus for supplying nonradioactive, clean steam as sealing steam to shaft sealing sections of a steam turbine of a nuclear power plant or the like.

Heretofore, in a steam generating apparatus for supplying nonradioactive steam as sealing steam to shaft sealing sections of a steam turbine of a nuclear power plant, it has been a common practice, as described in U.S. Pat. No. 3,604,206, to introduce condensate from a condensate storage tank into a shell containing feed water below the liquid level which is kept constant at all times. Steam for heating the condensate is supplied to heating pipes submerged in the feed water in the shell and the feed water is evaporated by the heat exchange taking place between the feed water and steam through the pipes, and the generated steam is supplied as sealing steam to the shaft sealing sections of the steam turbine.

In this type of steam generating apparatus, some difficulty would be encountered when the steam turbine is started. At turbine start-up, the demand for a supply of sealing steam to the shaft sealing portions is increased transiently and suddenly because the supply of sealing steam to the shaft sealing sections has been interrupted. This increase in the demand for a supply of sealing steam would cause an increase in the demand for a supply of condensate to the interior of the shell as feed water in proportion to the increase in the demand for a supply of sealing steam. Since the condensate is supplied to the interior of the shell from below the liquid level, the water in the shell would have its temperature lowered by the supply of condensate of low temperature which is temporarily increased in quantity, and evaporation of the water in the tank would not take place vigorously. Thus it would become impossible to obtain steam having a pressure and temperature necessary to the sealing steam. Stated differently, the steam generating apparatus of the type described would have the disadvantage of being poor in responding to a change in the quantity of the sealing steam required for the shaft sealing sections of the steam turbine, with a result that the shaft sealing would become ineffective temporarily.

SUMMARY OF THE INVENTION

This invention has as its object the provision of a steam generating apparatus capable of keeping the pressure and temperature of generated steam constant at all times, regardless of changes in the quantity of condensate supplied to the apparatus which would be caused by changes in the quantity of generated steam demanded.

According to the present invention, there is provided a steam generating apparatus comprising a shell containing feed water introduced thereinto; and heating pipes submerged in the feed water contained in said shell for permitting a heating fluid of high temperature to flow therethrough, indirect heat exchange being effected between the heating fluid and the feed water in said shell through said heating pipes so as to evaporate the feed water; said apparatus further comprising a spray valve mounted in a space above the liquid level of the feed water in said shell for scattering condensate in atomized particles in said shell, said spray valve including resilient means mounted therein for varying the degree of opening of said spray valve according to the pressure of the condensate supplied to said spray valve, arrangement being such that the atomized particles of the condensate delivered into said shell through said spray valve are brought into contact with steam generated in said shell and heated thereby to a saturation temperature corresponding to the internal pressure of said shell.

DESCRIPTION OF THE PREFERRED EMBODIMENT

Figure 1:
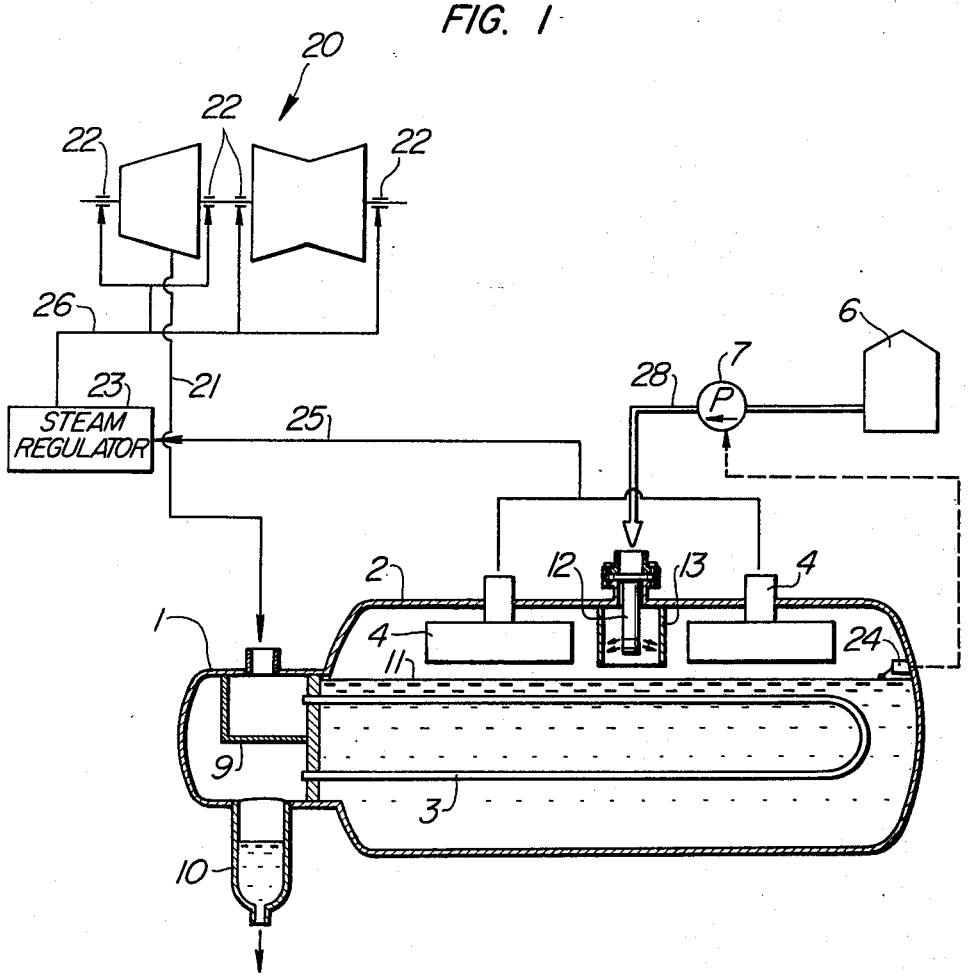
FIG. 1 is a schematic sectional view of the steam generating apparatus for generating sealing steam for shaft sealing sections of a steam turbine, which is one embodiment of the present invention.

A steam generating apparatus, which is one embodiment of this invention, will be described with reference to FIGS. 1 and 2. A steam generator used for supplying nonradioactive steam as sealing steam to shaft sealing sections 22 of a steam turbine 20 of a nuclear power plant includes a shell 2 containing feed water having a liquid level 11 kept constant at all times, and a spray valve 12 mounted in a space above the liquid level 11 within the shell 2 for scattering condensate, which is supplied from a condensate tank 6 through a conduit 28, in atomized particles through the valve 12 in the shell 2. Meanwhile steam extracted from the turbine 20 has its pressure reduced and is led, via an extraction conduit 21, to a header 1 formed with a partition plate 9 therein from which the steam flows through heating pipes 3 of the U-shape immersed in the feed water in the shell 2. The steam flowing through the heating pipes 3 is used as heating steam which undergoes heat exchange with the feed water in the shell 2 to evaporate the latter, the heating steam being condensed and collected in a drain tank 10 before being discharged to the outside. The steam generated by the evaporation of the water in the shell 2 has its moisture removed in a liquid/ gas separator 4 of the centrifugal or corrugated sheet type mounted in the space above the liquid level 11 in the shell 2, and led, via a conduit 25 out of the shell 2 of the steam generating apparatus, to be introduced as sealing steam, through a gland steam regulator 23, into the shaft sealing sections 22 of the turbine 20 via gland steam conduits 26.

When there is an increase in the demand of sealing steam for the shaft sealing sections 22 of the turbine 20, namely when there is an increase in the load of the steam generator, the quantity of steam generated in the shell 2 increases and the liquid level 11 of the water in the shell 2 falls. In this case, a water gauge 24 mounted in the shell 2 detects the change in the liquid level and actuates a condensate pump 7 in the conduit 28 to increase the supply of condensate from the condensate tank 6 to thereby keep constant at all times the liquid level in the shell 2.

Figure 2:
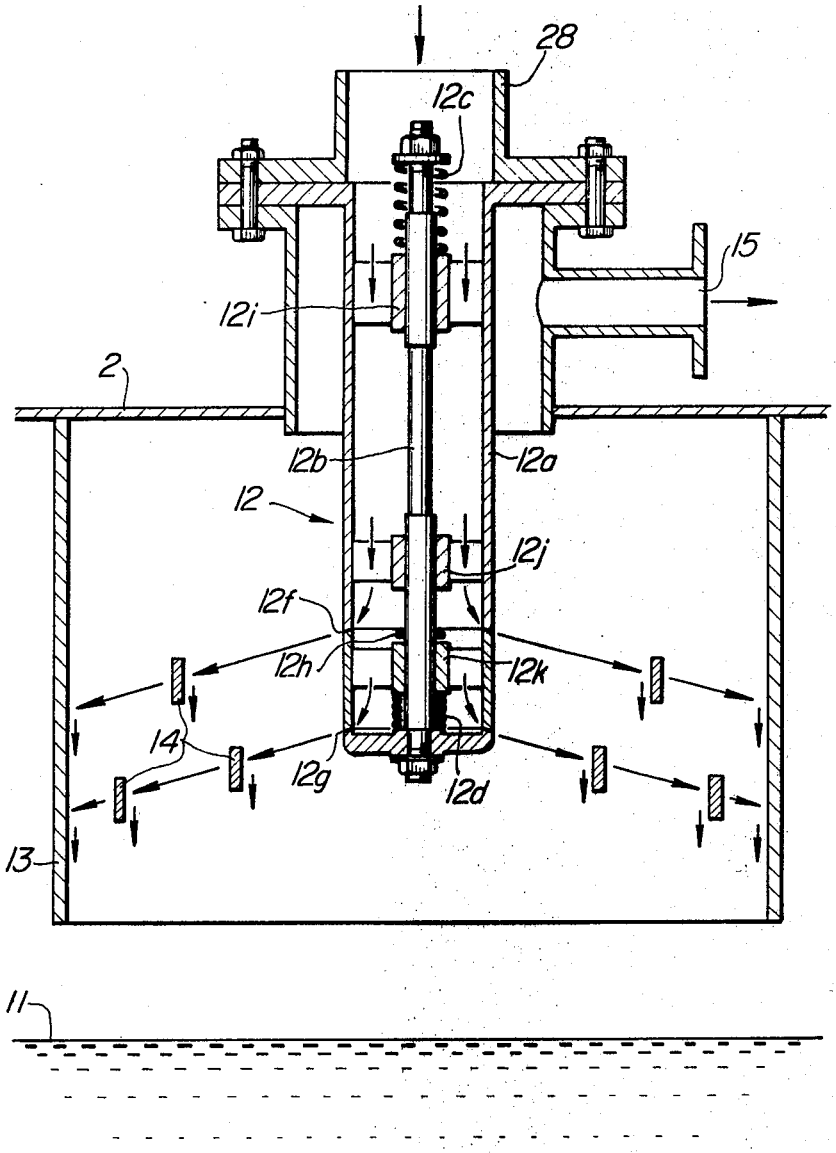
FIG. 2 is a fragmentary sectional view of condensate spraying means of the steam generating apparatus shown in FIG. 1, showing the construction of the condensate spraying means in detail.

On the other hand, the spray valve 12 for scattering the condensate in atomized particles in the shell 2 includes, as shown in FIG. 2, a cylindrical valve casing **12*a*, and a valve stem 12*b* arranged in the valve casing 12*a*. The valve casing 12*a* is of three-piece construction and divided into upper, intermediate and lower portions mounting thereon support members 12***i*, 12*j* and 12*k* respectively for supporting the valve stem 12*b* for vertical movement. More specifically, the valve casing 12*a* is separated into three portions and annular openings 12*f* and 12*g* are formed between the discrete portions of the valve casing 12*a* when they are axially moved away from each other. The valve stem 12*b* is fixed at its lower end to the lower portion of the valve casing 12*a*. A spring 12*c* is mounted between an upper end portion of the valve stem 12*b* and the support member 12*i*, and another spring 12*d* is mounted between the lower portion of the valve casing 12*a* and the support member 12*k*. The springs 12*c* and 12*d* operate in response to the pressure of the condensate supplied to the interior of the valve casing 12*a* such that the annular openings 12*g* and 12*f* are successively formed as the above-mentioned pressure increases. A stopper 12*h* is mounted on the valve stem 12*b* between the support members 12*j* and 12*k*. When the quantity of the condensate supplied to the interior of the valve casing 12*a* is relatively small and the pressure of the condensate in the casing 12*a* is relatively low, such low pressure overcomes the biasing force of the spring 12*c*, and moves downwardly the lower portion of the valve casing 12*a* together with the valve stem 12*b*, so that only the annular opening 12*g* is formed, and the condensate in the casing 12*a* is sprayed therethrough in the shell 2. When the quantity of the condensate supplied to the interior of the valve casing 12*a* is increased and the pressure of the condensate in the casing 12*a* becomes higher, such pressure overcomes the biasing force of the spring 12*c*, and moves the valve stem 12*b* further downwardly together with the intermediate portion of the valve casing 12*a* by the engagement of the stopper 12*h* with the support member 12*k* to thereby additionally form the annular opening 12*f* to spray the condensate therethrough in the shell 2, and this increases the quantity of the condensate sprayed.

Thus, when the quantity of the condensate supplied to the spray valve 12 is small, that is, when the quantity of the sealing steam required for the shaft sealing sections of the steam turbine is relatively small, the condensate is sprayed in the membranous state in the shell 2 only through the lower opening 12*g*. However, when the quantity of the condensate as above-mentioned is increased, the condensate is sprayed in the membranous state through the upper opening 12*f* while being sprayed in the lower opening 12*g*. Thus it is possible to maintain the degree of opening of the spray valve 12 in conformity with the quantity of condensate supplied to the spray valve 12 at all times. The condensate sprayed through the annular openings 12*g* and 12*f* is brought into contact, in the space above the liquid level 11 in the shell 2, with the steam generated in the shell 2, and heated thereby to a saturation temperature corresponding to the internal pressure of the shell 2, so that no large drop occurs in the temperature of the feed water contained in the shell 2. In order that the sprayed condensate may be thoroughly heated, a cylindrical baffle member 13 is mounted around the spray valve 12 in concentric relation therewith so that the atomized particles of the condensate may flow downwardly and come into contact with the generated steam which flows upwardly, to ensure that the condensate is positively brought into contact with the generated steam.

A plurality of deflectors 14 disposed at varying distances from the valve stem 12*b* are arranged around the spray valve 12 so that all the atomized particles of the condensate may not impinge on the baffle member 13 to fall downwardly therealong. It is intended that portions of the atomized particles of the condensate impinge on the deflectors 14 and flow downwardly therealong into contact with the generated steam flowing upwardly, so as to thereby effectively heated. A gas outlet port 15 is provided for discharging noncondensing gas to the outside of the shell 2.

From the foregoing description, it will be appreciated that, even if the demand for sealing steam to be supplied to shaft sealing sections of a steam turbine suddenly increases and the quantity of the condensate supplied to the steam generating apparatus increases as at starting of the steam turbine, the temperature of feed water contained in the shell shows no appreciable drop because the condensate is supplied via the spray valve and scattered in atomized particles in the shell to come into contact with the steam generated in the shell so that the atomized particles of the condensate may be heated to a saturation temperature corresponding to the internal pressure of the shell. Therefore, the steam generating apparatus constructed as aforesaid enables steam of constant pressure and constant temperature to be generated at all times. Thus the steam generating apparatus according to the present invention can obtain the effect of supplying the steam of constant pressure and constant temperature irrespective of changes in the quantity of condensate supplied thereto.

What is claimed is:

1. A steam generating apparatus comprising:

a shell containing feed water introduced thereinto; and heating pipes submerged in the feed water contained in said shell for permitting a heating fluid of high temperature to flow therethrough, indirect heat exchange being effected between the heating fluid and the feed water in said shell through said heating pipes so as to evaporate the feed water;

said apparatus further comprising a spray valve mounted in a space above the liquid level of the feed water in said shell for scattering condensate in atomized particles in said shell, said spray valve including resilient means mounted therein for varying the degree of opening of said spray valve according to the pressure of the condensate supplied to said spray valve, arrangement being such that the atomized particles of the condensate delivered into said shell through said spray valve are brought into contact with steam generated in said shell and heated thereby to a saturation temperature corresponding to the internal pressure of said shell.

2. A steam generating apparatus as set forth in claim 1, wherein said spray valve comprises a cylindrical member divided into a plurality of portions separated from each other, at least one annular opening being formed between discrete portions of said cylindrical member when they are axially moved away from each other; and a valve stem disposed in said cylindrical member for sliding movement and on which the biasing force of said resilient means is exerted.

3. A steam generating apparatus as set forth in claim 2, wherein said resilient means comprises two springs which are mounted so as to exert biasing forces on said valve stem upwardly and downwardly, respectively, and said valve stem is fixed at its lower end to the lowermost portion of said cylindrical member, arrangement being such that said at least one annular opening for spraying the condensate can be varied depending upon the pressure of the condensate supplied to the interior of said cylindrical member.

4. A steam generating apparatus as set forth in claim 1, further comprising baffle wall means disposed around said spray valve.

5. A steam generating apparatus as set forth in claim 4, further comprising a plurality of deflectors interposed between said spray valve and said baffle wall means and surrounding said spray valve.

6. A steam generating apparatus as set forth in claim 5, wherein said plurality of deflectors are located at varying distances from said spray valve.

7. A steam generating apparatus as set forth in claim 1, further comprising moisture separating means mounted in the space above the liquid level of the feed water contained in said shell for removing moisture from the steam generated in said shell.

8. A steam generating apparatus as set forth in claim 7, wherein the steam generated in said shell and having moisture removed therefrom is supplied as sealing steam to shaft sealing sections of a steam turbine.

* * * * *